US009315040B2

(12) United States Patent
Inoue

(10) Patent No.: US 9,315,040 B2
(45) Date of Patent: Apr. 19, 2016

(54) INKJET PRINTER

(71) Applicant: Seiko Epson Corporation, Tokyo (JP)

(72) Inventor: Ken Inoue, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/667,111

(22) Filed: Mar. 24, 2015

(65) Prior Publication Data

US 2015/0273852 A1 Oct. 1, 2015

(30) Foreign Application Priority Data

Mar. 26, 2014 (JP) ..... 2014-063234

(51) Int. Cl.

| | |
|---|---|
| ***B41J 2/175*** | (2006.01) |
| ***B41J 2/19*** | (2006.01) |
| ***B41J 29/02*** | (2006.01) |
| ***B41J 29/13*** | (2006.01) |

(52) U.S. Cl.

CPC ..... *B41J 2/17596* (2013.01); *B41J 2/175* (2013.01); *B41J 2/17509* (2013.01); *B41J 2/19* (2013.01); *B41J 29/02* (2013.01); *B41J 29/13* (2013.01)

(58) Field of Classification Search

CPC ..... B41J 2/17596

See application file for complete search history.

(56) References Cited

U.S. PATENT DOCUMENTS

| | | | | |
|---|---|---|---|---|
| 5,777,652 | A * | 7/1998 | Takeuchi | 347/171 |
| 2003/0146958 | A1 | 8/2003 | Aruga et al. | |
| 2004/0021107 | A1 | 2/2004 | Kimura et al. | |
| 2005/0073559 | A1 | 4/2005 | Aruga et al. | |
| 2007/0051910 | A1 | 3/2007 | Kimura et al. | |
| 2007/0115333 | A1 | 5/2007 | Aruga et al. | |
| 2010/0271447 | A1 | 10/2010 | Aruga et al. | |
| 2012/0212549 | A1 | 8/2012 | Aruga et al. | |
| 2013/0235127 | A1 | 9/2013 | Aruga et al. | |
| 2014/0210909 | A1 | 7/2014 | Aruga et al. | |
| 2015/0022596 | A1 | 1/2015 | Aruga et al. | |

FOREIGN PATENT DOCUMENTS

| | | | |
|---|---|---|---|
| JP | 2003-301964 | A | 10/2003 |
| JP | 2006-150626 | A | 6/2006 |
| JP | 2007-015409 | A | 1/2007 |

* cited by examiner

*Primary Examiner* — Manish S Shah
*Assistant Examiner* — Jeffrey C Morgan
(74) *Attorney, Agent, or Firm* — Nutter McClennen & Fish LLP; John J. Penny, Jr.

(57) ABSTRACT

An inkjet printer 1 has an ink path 35 communicating with a printhead 12, and a choke unit 46 for closing the ink path 35. The choke unit 46 includes a diaphragm valve 75 that is part of the wall of the ink path 35, a disc moving mechanism 76, and a drive motor 47 as the drive source. The disc moving mechanism 76 moves the diaphragm valve 75 between a closed-channel position 75A in contact with an opposite wall part (bottom 67*a* of the cavity 67) of the wall opposite the diaphragm valve 75, and an open-channel position 75B separated from this opposite wall part. The disc moving mechanism 76 is located outside the ink path 35.

5 Claims, 8 Drawing Sheets

INKJET PRINTER

BACKGROUND

1. Technical Field

The present invention relates to an inkjet printer having a choke unit for closing the ink path at a position on the ink path between the ink cartridge and the printhead.

2. Related Art

Ink ejection problems can result from air bubbles in the ink path flowing into the printhead. Inkjet printers may therefore have a bubble trap disposed to the ink path to capture any air bubbles. Such inkjet printers perform a choke cleaning operation to purge the bubbles in the bubble trap from the printhead side when the air bubbles in the bubble trap are expected to reach a preset size.

This choke cleaning operation closes the ink path at a position upstream from the bubble trap by means of a choke unit. The nozzle face of the printhead is then covered by a cap, the inside of the cap is then depressurized by a suction means, and negative pressure is produced in the ink path. The choke unit is then opened in this negative pressure state, and the bubbles in the bubble trap are discharged in a burst with ink from the ink nozzles.

An inkjet printer that performs this choke cleaning operation is described in JP-A-2003-301964.

The choke unit of the inkjet printer described in JP-A-2003-301964 has a disc disposed inside the ink path, and an electromagnet on the outside of the ink path. The disc has a support member made from a magnetic material, and moves between a closed position choking the ink path closed, and an open position where the ink path is open. To choke the ink path closed, the electromagnet is driven to attract the support member by the force of magnetic attraction and move the disc from the open position to the closed position.

Because magnetic force is inversely proportional to the distance squared, it is not easy to increase the stroke of the disc that opens and closes the ink path or to increase the magnetic force applied to the disc when using a configuration that moves a disc located inside the ink path by means of magnetic force from outside the ink path. The flow path of the ink path must therefore be narrow in the area around the choke unit, and flow resistance therefore increases in this area. Because pressure loss increases when the flow resistance increases, controlling the amount of ink in the ink droplets ejected from the printhead with good precision becomes difficult.

SUMMARY

With consideration for this problem, an inkjet printer according to the invention has a choke unit that reduces the flow resistance when the ink path is open.

An inkjet printer according to the invention has a printhead; an ink path that communicates the printhead with an ink cartridge; and a choke unit disposed on the ink path to close the ink path. The choke unit includes a diaphragm valve that forms part of a wall partitioning the ink path; a disc moving mechanism that moves the diaphragm valve from outside the ink path between a closed-channel position where the diaphragm valve contacts the wall at an opposite wall part opposite the diaphragm valve, and an open-channel position retracted from the opposite wall part; and a drive motor that drives the disc moving mechanism.

In this configuration, the disc of the choke unit is a diaphragm valve that is part of the wall of the ink path, and this diaphragm valve is driven from outside the ink path by a disc moving mechanism that is driven by the drive motor. Displacement of the diaphragm valve (the stroke of the disc) can therefore be greater than with a configuration that moves a disc inside the ink path by means of magnetic force from outside the ink path. There is also no need for a disc inside the ink path and a support member that supports the disc. Flow resistance when the ink path is open can therefore be reduced.

Preferably, an upstream opening of a downstream channel part of the ink path located on the downstream side of the diaphragm valve is disposed to the opposite wall part; and the diaphragm valve closes the upstream opening when in the closed-channel position.

Thus comprised, closing the ink path by the diaphragm valve is simple, and the ink path can be reliably choked closed by the diaphragm valve.

To open and close the ink path by driving the drive motor, the disc moving mechanism preferably includes a moving member that is attached to the diaphragm valve and moves between a closed position where the diaphragm valve is at the closed-channel position, and an open position where the diaphragm valve is at the open-channel position; an urging member that urges the diaphragm valve to the closed-channel position by urging the moving member to the closed position; a cam; a link member including a connecting part connected to the moving member, and a cam follower that slides against the cam; and a power transfer mechanism that transfers rotation of the drive motor to the cam. When the drive motor drives in a first direction and rotates the cam, the link member moves the moving member from the closed position to the open position. When the drive motor turns in a second direction that is the reverse of the first direction and rotates the cam, the link member moves the moving member from the open position to the closed position.

Further preferably, the power transfer mechanism has an intermittent gear connected coaxially to the cam, and a transfer gear that transfers rotation of the drive motor to the intermittent gear. The intermittent gear has an intermittent gear body with a toothed part formed to part of the circumference; a first latch member having a first catch tooth at one circumferential end of the toothed part when seen from the axial end of the axle of the intermittent gear body; a second latch member having a second catch tooth at the other circumferential end of the toothed part; and a spring member.

The first latch member rotates on a first axle parallel to the axle of the intermittent gear body, and moves between a first proximal position where the first catch tooth is proximal to the toothed part, and a first retracted position where the first catch tooth is removed to one side from the toothed part.

The second latch member rotates on a second axle parallel to the axle of the intermittent gear body, and moves between a second proximal position where the second catch tooth is proximal to the toothed part, and a second retracted position where the second catch tooth is removed to the other side from the toothed part.

The spring member urges the first latch member to the first proximal position, and urges the second latch member to the second proximal position.

Thus comprised, drive power from the drive motor transferred to the transfer gear can be easily transmitted to the intermittent gear. Because the intermittent gear body can be driven a constant angle of rotation when the drive motor drives a specific drive time, the cam can also be driven a constant angle of rotation. Controlling the operation that drives the drive motor and moves the diaphragm valve is therefore simple.

Further preferably, the inkjet printer also has a control unit that controls driving the drive motor, and moves the diaphragm valve by driving the drive motor a predetermined drive time in the first direction or the second direction.

Thus comprised, controlling the drive motor is simple.

Effect of the Invention

The choke unit of the invention drives a diaphragm valve that is part of a wall of the ink path by a drive motor from outside the ink path. The diaphragm valve can therefore be driven with a large displacement. There is also no need for a disc inside the ink path and a support member that supports the disc. Flow resistance when the ink path is open can therefore be reduced.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of an inkjet printer according to the present invention is described below with reference to the accompanying figures.

Figure 1A:
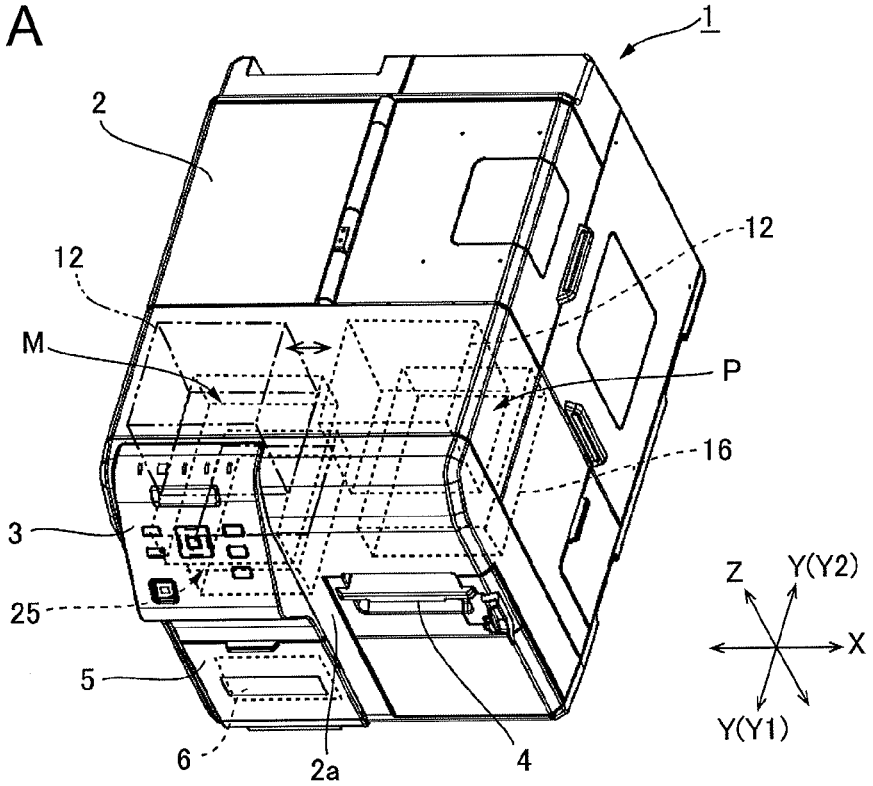
FIGS. 1A and 1B are an external oblique view and a section view of an inkjet printer according to the invention.
Figure 1B:
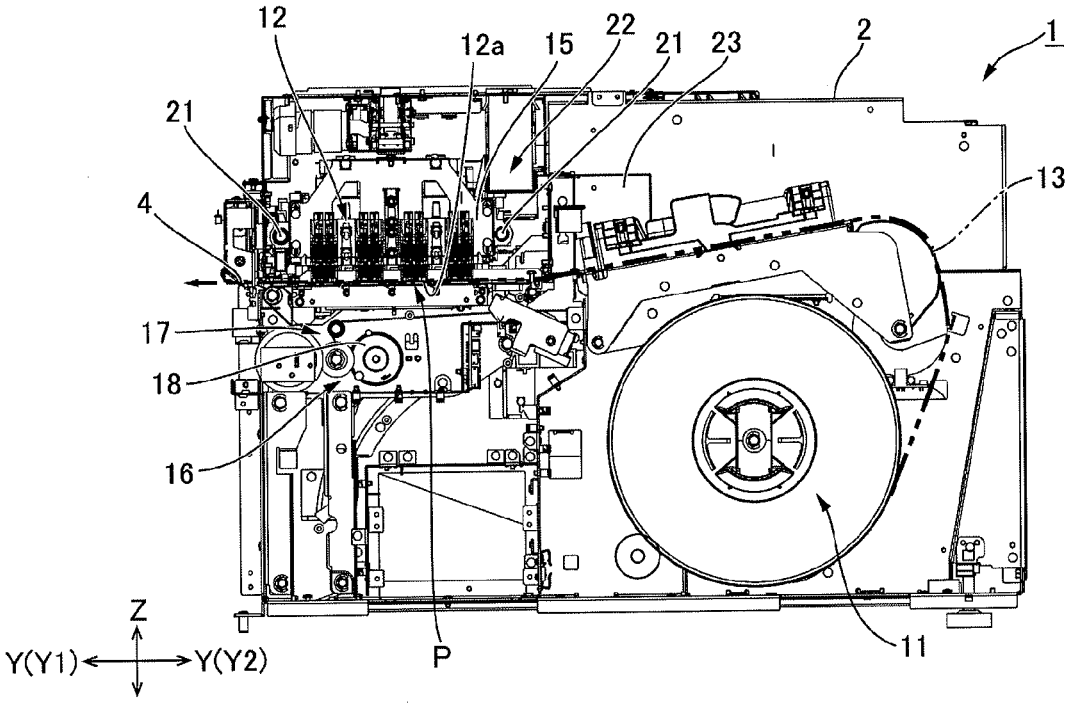
Figure 2:
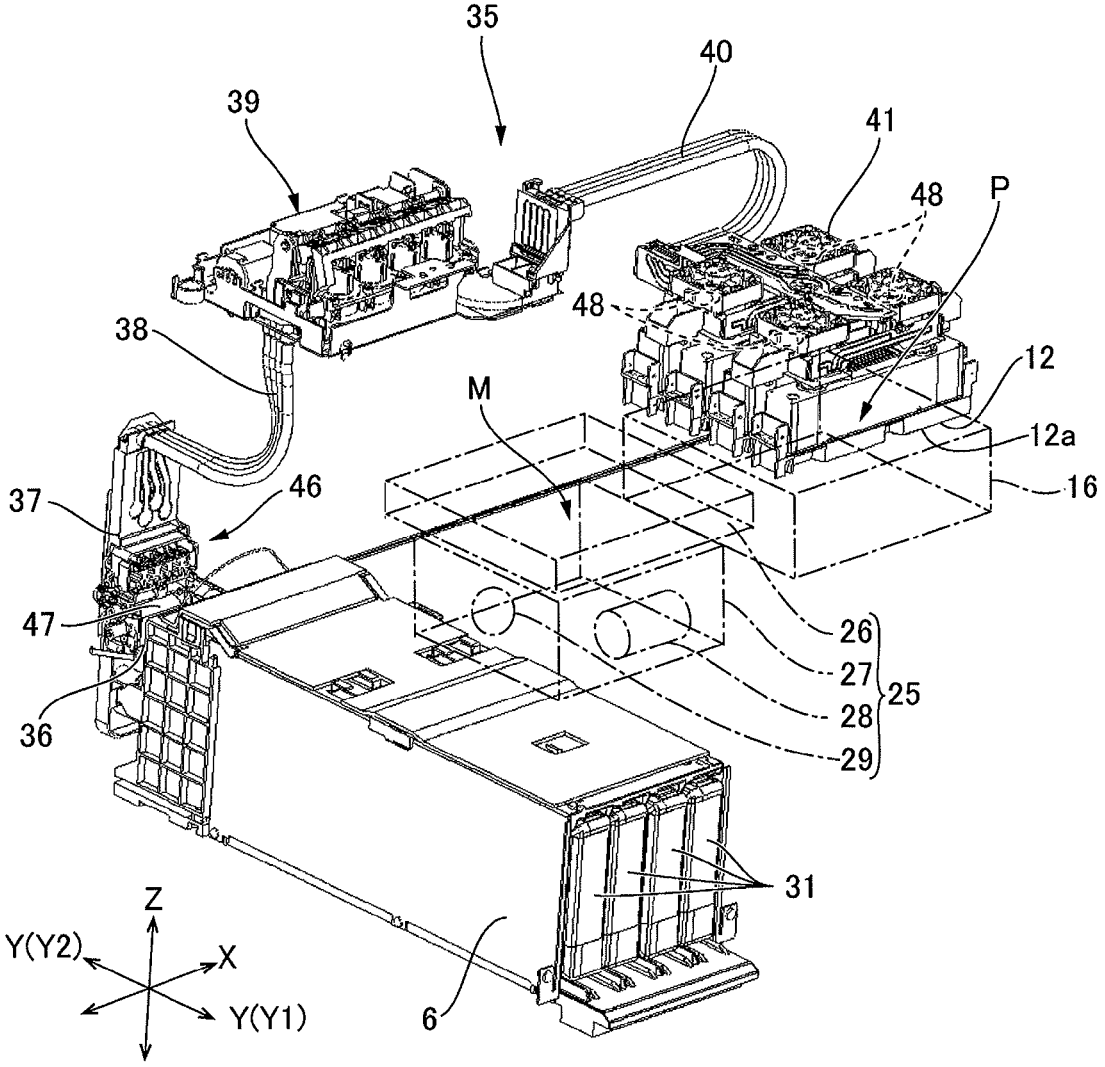
FIG. 2 is an oblique view of the ink supply system in the inkjet printer shown in FIGS. 1A and 1B.

FIG. 1 A is an external oblique view of an inkjet printer according to the invention, and FIG. 1B is a section view showing the inside of the printer. FIG. 2 is an oblique view of the ink supply system in the inkjet printer 1 shown in FIGS. 1A and 1B.

As shown in FIG. 1A, the inkjet printer 1 has a printer cabinet 2 that is basically box-shaped and is long from front to back. An operating panel 3 is disposed at the top of the front 2*a* of the printer cabinet 2, and a paper exit 4 is formed on the other side. An access cover 5 is disposed below the operating panel 3. The access cover 5 opens and closes the cartridge loading unit 6 disposed inside the printer cabinet 2.

Note that the invention is described below with reference to three mutually perpendicular axes, the transverse axis X, longitudinal axis Y, and vertical axis Z.

As shown in FIG. 1B, a roll paper compartment 11 for holding a paper roll is formed at the bottom at the back inside the printer cabinet 2. A paper conveyance path 13 is formed inside the printer cabinet 2 from the roll paper compartment 11 to the paper exit 4 passing the printing position P of the printhead 12. The paper conveyance path 13 extends at an upward angle from the roll paper compartment 11 to the back Y2 (the back on the longitudinal axis Y), and then curves to the front Y1 (the front on the longitudinal axis Y) and continues to the front Y1 to the paper exit 4.

The printhead 12 is disposed at the top at the front end side of the printer cabinet 2. The printhead 12 is an inkjet head, and is mounted on a carriage 15 with the nozzle face 12*a* facing down.

A platen unit 16 is disposed below the printhead 12 with a specific gap to the nozzle face 12*a*. The printing position P is defined by the platen unit 16.

A conveyance mechanism 17 that conveys continuous recording paper delivered from the paper roll is disposed to the platen unit 16. A paper feed motor 18 is provided as the drive source of the conveyance mechanism 17.

A pair of carriage guide rails 21 are disposed parallel to the transverse axis X with the carriage 15 therebetween on the longitudinal axis Y. The carriage 15 is supported movably on the transverse axis X by the pair of carriage guide rails 21.

A carriage moving mechanism 22 that moves the carriage 15 on the transverse axis X along the pair of carriage guide rails 21 is provided on the back Y2 side of the printhead 12. A carriage motor 23 is provided as the drive source of the carriage moving mechanism 22.

Figure 3:
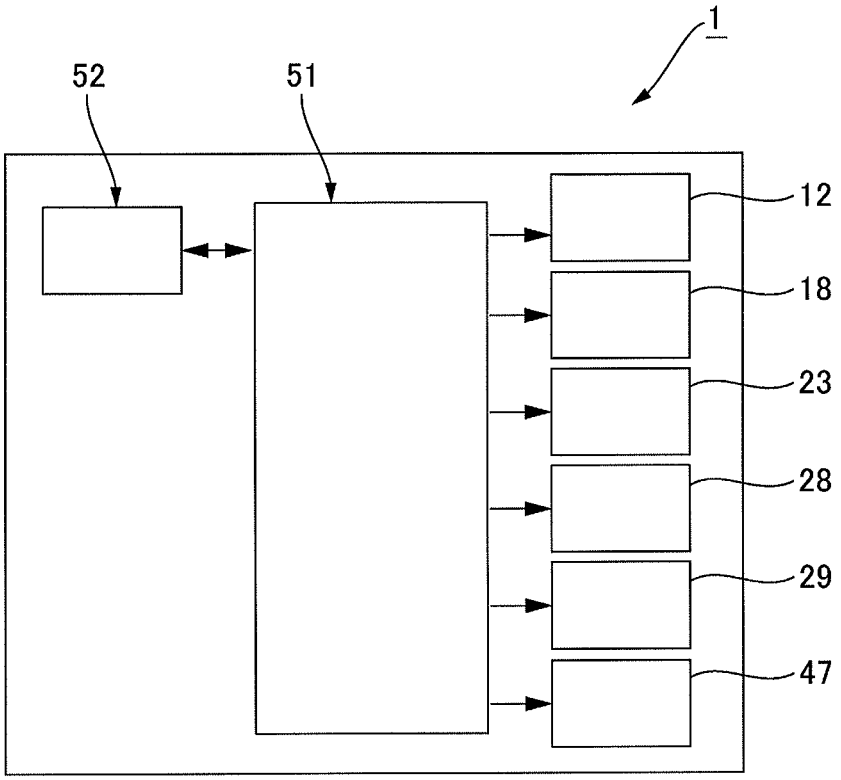
FIG. 3 is a block diagram of the control system of the inkjet printer shown in FIGS. 1A and 1B.

By moving the carriage 15 on the transverse axis X, the printhead 12 moves between the printing position P and a maintenance position M removed outside of the paper conveyance path 13 on the transverse axis X (FIG. 1A). A head maintenance unit 25 is disposed to the maintenance position M. As shown in FIG. 3, the head maintenance unit 25 includes a head cap 26 that is opposite the nozzle face 12*a* of the printhead 12 when in the maintenance position M, and a cap moving mechanism 27 that moves the head cap 26 up and down between a capping position covering the nozzle face 12*a*, and an open head position separated from the nozzle face 12*a*. A lift motor 28 is provided as the drive source of the cap moving mechanism 27. The head maintenance unit 25 also has a suction pump 29 that suctions ink from the printhead 12 through the head cap 26.

Ink Supply System

As shown in FIG. 2, the ink supply system includes ink cartridges 31 installed in the cartridge loading unit 6, and an ink path 35 connecting the ink cartridges 31 to the printhead 12. The ink path 35 includes from the upstream side to the downstream side in the direction of the ink supply from the ink cartridges 31 to the printhead 12: a cartridge loading unit 36, a flat channel 37, a first flexible channel 38, a diaphragm pump 39, a second flexible channel 40, and a subtank 41. Four ink cartridges 31 respectively supplying black ink, cyan ink, magenta ink, and yellow ink are loaded in the cartridge loading unit 6. The ink path 35 has four ink channels for respectively supplying the black ink, cyan ink, magenta ink, and yellow ink to the printhead 12.

The cartridge loading unit 36 has ink needles 45 (FIG. 4) that connect to the ink supply openings of the ink cartridges 31. A choke unit 46 that can choke the ink path 35 closed is disposed to the flat channel 37. A drive motor 47 is provided as the drive source of the choke unit 46.

The diaphragm pump 39 suctions ink from the ink cartridges 31 and supplies the ink to the subtank 41. The subtank 41 has a pressure adjusting mechanism (not shown in the figure) and supplies ink to the printhead 12 with a specific ink pressure. Air can become mixed with the ink and form bubbles in the ink path 35. Ink ejection problems can result from bubbles flowing into the printhead 12. A bubble trap 48 that traps the bubbles is therefore disposed to the flow path portion of the ink path 35 inside the subtank 41.

Control System

FIG. 3 is a block diagram showing the control system of the inkjet printer. As shown in FIG. 3, the inkjet printer 1 has a control unit 51 including a CPU and memory such as ROM or RAM. A communication unit 52 that communicatively connects to an external device is connected to the control unit 51. The communication unit 52 receives print data from an external device and supplies the print data to the control unit 51. The printhead 12, paper feed motor 18, carriage motor 23, lift motor 28, suction pump 29, and drive motor 47 are connected to the output side of the control unit 51 through drivers not shown.

Printing Operation and Maintenance Operation

In the standby mode, the printhead 12 is at the maintenance position M. The nozzle face 12*a* of the printhead 12 is also covered by the head cap 26. The recording paper is pulled from the paper roll loaded in the roll paper compartment 11, and is set through the paper conveyance path 13.

When print data is supplied from an external device and the print data is passed through the communication unit 52 to the control unit 51, the control unit 51 controls driving the lift motor 28 to move the head cap 26 away from the nozzle face 12*a* of the printhead 12. The control unit 51 also controls driving the printhead 12 and flushes a specific amount of ink from the printhead 12 into the head cap 26. Flushing is a maintenance operation for preventing or suppressing clogging of the ink nozzles.

The control unit 51 then controls driving the carriage motor 23 to move the printhead 12 from the maintenance position M to the printing position P by the head moving mechanism 14. The control unit 51 also controls driving the paper feed motor 18 to convey the recording paper at a specific speed by means of the conveyance mechanism 17.

The control unit 51 also controls driving the printhead 12 to eject ink from the printhead 12 and print the print data on the recording paper passing the printing position P at a specific speed.

When printing ends, the control unit 51 controls driving the carriage motor 23 to move the printhead 12 from the printing position P to the maintenance position M by means of the head moving mechanism 14. The control unit 51 also drives the lift motor 28 to cover the nozzle face 12*a* of the printhead 12 with the head cap 26.

If the bubbles collected in the bubble trap 48 disposed to the ink path 35 are estimated to have reached a predetermined amount, the control unit 51 controls driving the drive motor 47 of the choke unit 46 and the suction pump 29 of the head maintenance unit 25 for the choke cleaning operation. The bubbles collected in the bubble trap 48 will exceed the preset amount when the time past since the last choke cleaning operation has reached a specific time. The choke cleaning operation is therefore executed whenever this specific time passes.

Choke cleaning is an operation that purges bubbles in the bubble trap 48 from the printhead 12 side, and is a maintenance operation that prevents printhead 12 ejection problems. In the choke cleaning operation the choke unit 46 chokes off the flat channel 37 located on upstream from the bubble trap 48 on the ink path 35. The head cap 26 then covers the nozzle face 12*a* of the printhead 12 and the suction pump 29 is driven to reduce the pressure inside the head cap 26 and create negative pressure inside the ink path 35. Next, the choke unit 46 opens while the ink path 35 is in the negative pressure state, and bubbles inside the bubble trap 48 are ejected with ink in a single burst from the ink nozzles.

Choke Unit

Figure 4:
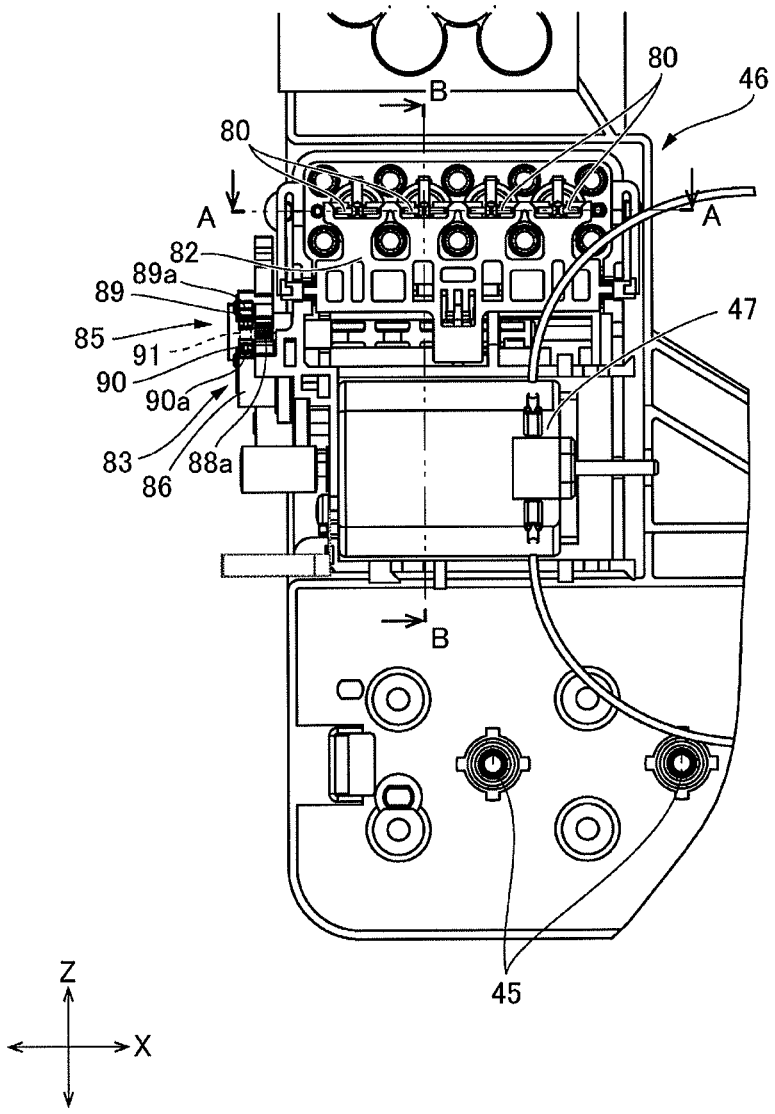
FIG. 4 is a front view of the choke unit.
Figure 5A:
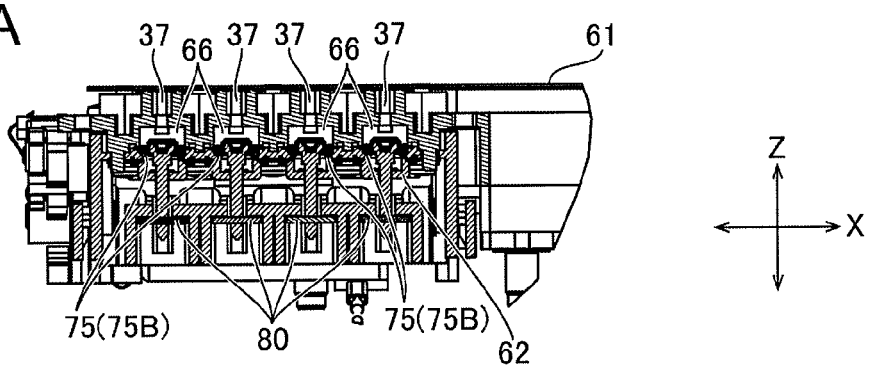
FIGS. 5A-5C are section views of the choke unit when the ink path is open.
Figure 5B:
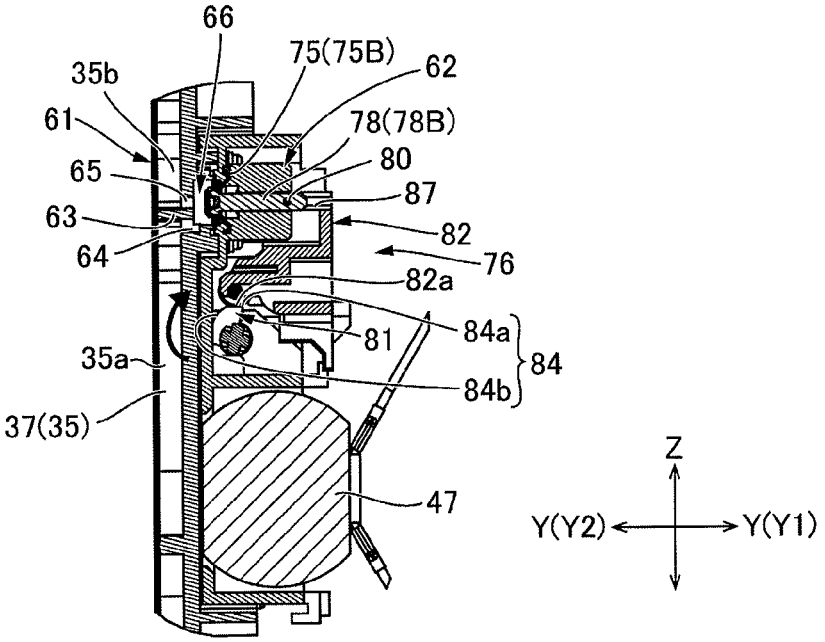
Figure 5C:
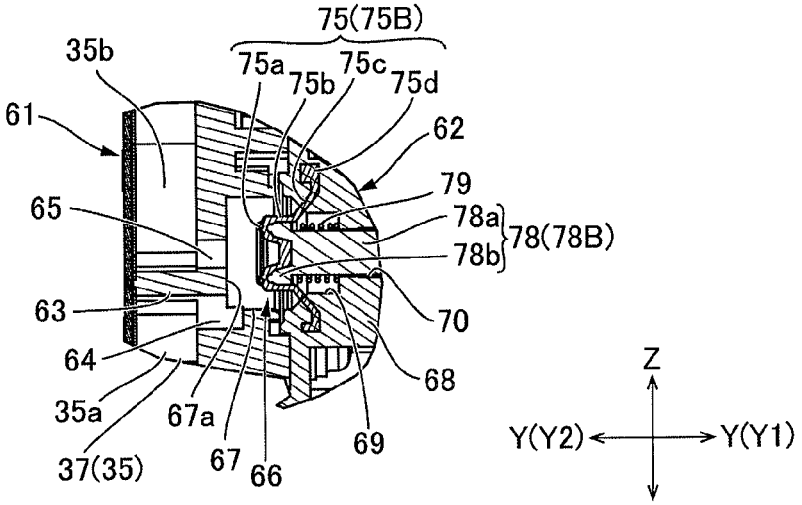
Figure 6A:
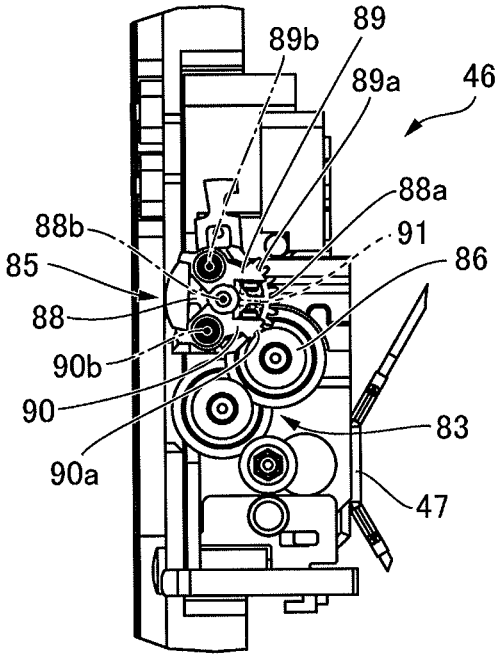
FIGS. 6A and 6B are side views of the choke unit when the ink path is open.
Figure 6B:
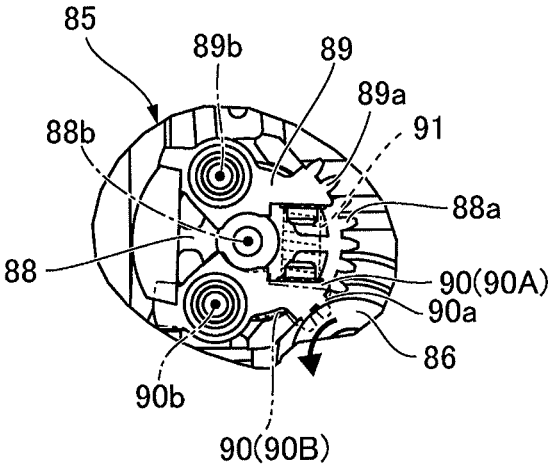
Figure 7A:
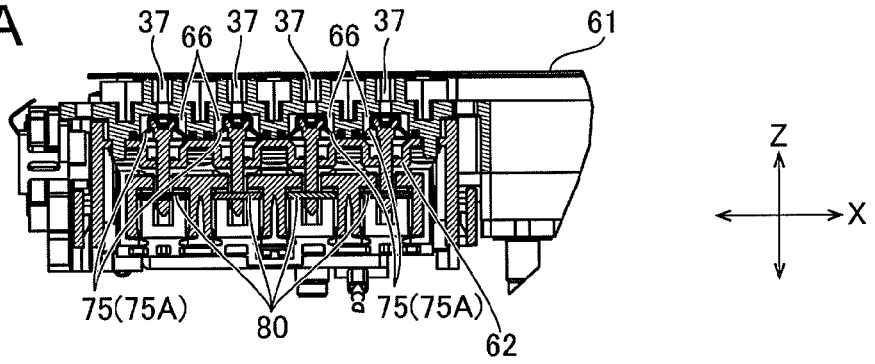
FIGS. 7A-7C are section views of the choke unit when the ink path is closed.
Figure 7B:
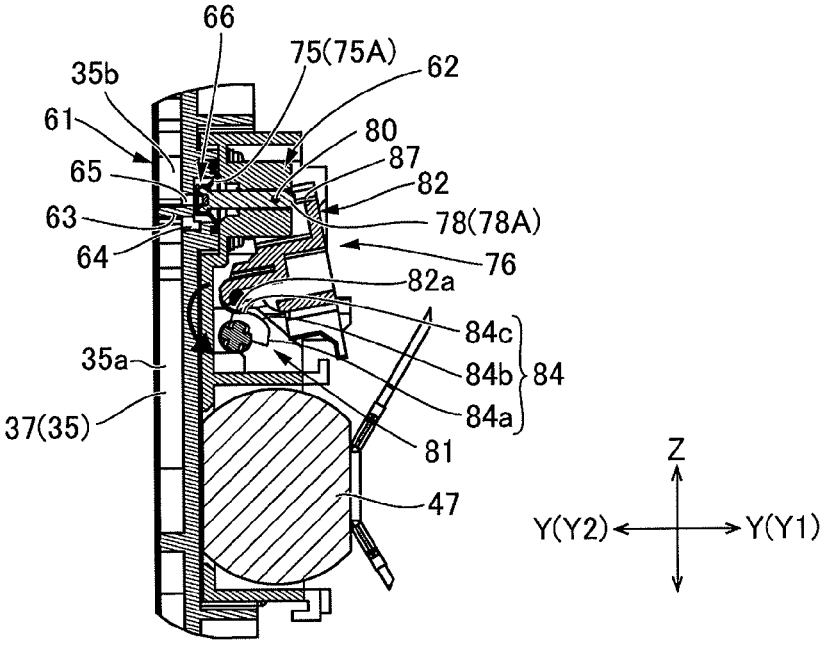
Figure 7C:
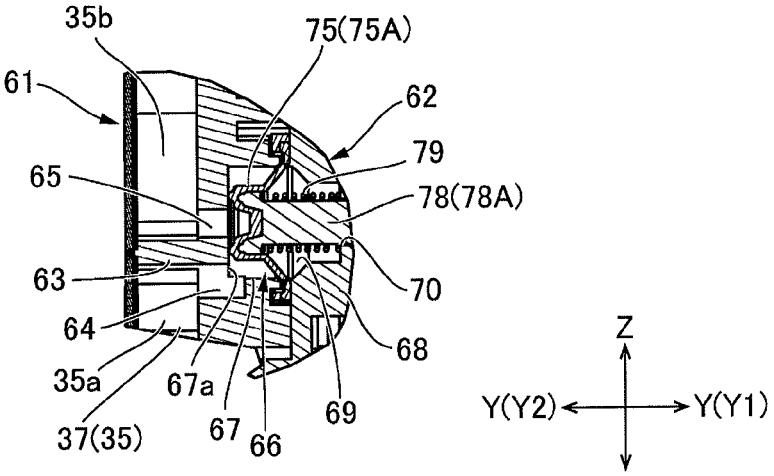
Figure 8A:
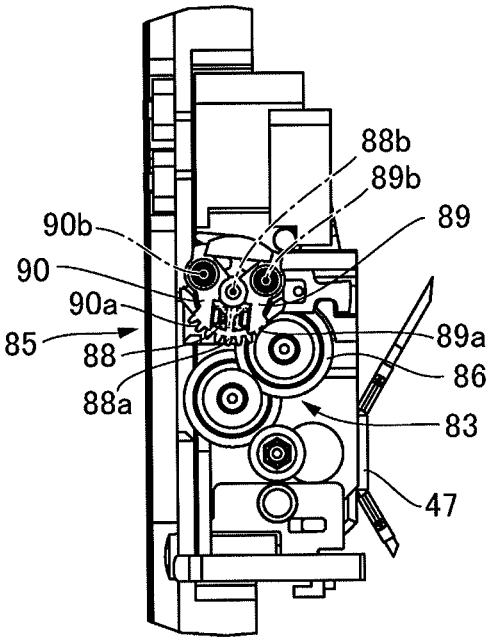
FIGS. 8A and 8B are side views of the choke unit when the ink path is closed.
Figure 8B:
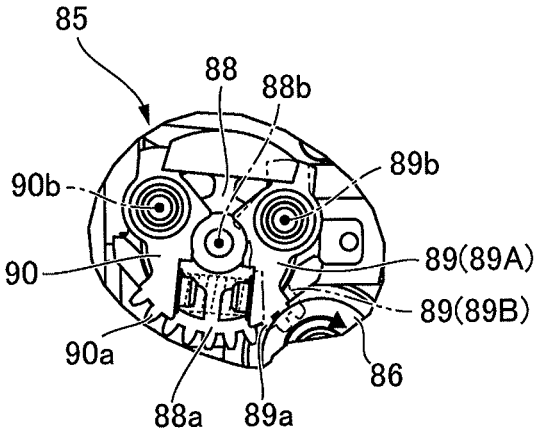

The choke unit 46 is described next with reference to FIG. 4 to FIG. 7C. FIG. 4 is a front view of the choke unit 46 from the front. FIGS. 5A-5C illustrate the choke unit 46 when the ink path 35 is open. FIG. 5A is a section view through line A-A in FIG. 4, FIG. 5B is a section view through line B-B in FIG. 4, and FIG. 5C is an enlarged section view of the choke unit 46 in the area around the disc. FIG. 6A is a side view of the choke unit 46 when the ink path 35 is open, and FIG. 6B is an enlarged view of the choke unit 46 in the area around the intermittent gear. FIGS. 7A-7C illustrate the choke unit 46 when the ink path 35 is closed. FIG. 7A is a section view through line A-A in FIG. 4, FIG. 7B is a section view through line B-B in FIG. 4, and FIG. 7C is an enlarged section view of the choke unit 46 in the area around the disc. FIG. 8A is a side view of the choke unit 46 when the ink path 35 is closed, and FIG. 8B is an enlarged view of the choke unit 46 in the area around the intermittent gear.

As shown in FIGS. 5A-5C, the flat channel 37 is segmented by a rear channel member 61 and a front channel member 62 with a specific gap therebetween on the longitudinal axis Y. The rear channel member 61 is a flat panel. The front channel member 62 is located in front of the rear channel member 61 and has a flat surface portion facing the rear channel member 61. The choke unit 46 includes a partition 63 that extends from the rear channel member 61 toward the front Y1 to the front channel member 62 through the flat channel 37; a bottom opening 64 and a top opening 65 formed in the front channel member 62 above and below the partition 63; and a detour channel 66 through which the bottom opening 64 and top opening 65 communicate. The detour channel 66 connects an upstream channel part 35*a* located in the flat channel 37 (ink path 35) on the ink cartridge 31 side of the partition 63; and a downstream channel part 35*b* located on the printhead 12 side of the partition 63.

As shown in FIG. 5C, the detour channel 66 has a cavity 67 formed in the front channel member 62 on the opposite side as the rear channel member 61, and a frame 68 that covers the cavity 67 from the front Y1 side. The cavity 67 is recessed toward the back Y2, and the bottom opening 64 and top opening 65 are formed in the bottom 67*a* (back surface) of the cavity 67. The frame 68 has frame-side cavity 69 recessed to the front Y1 at a position opposite the cavity 67. The back end opening of the frame-side cavity 69 is shaped identically to the front end opening of the cavity 67. The frame 68 also has a frame through-hole 70 extending toward the front Y1 from the center of the frame-side cavity 69 to the front end of the frame 68.

A diaphragm valve 75 is disposed to the frame 68 covering the frame-side cavity 69. The diaphragm valve 75 is round and has an annular rib 75*a* in the center.

The diaphragm valve 75 also has an annular wall 75*b* extending toward the front Y1 from the outside of the annular rib 75*a*, an annular tapered portion 75*c* that slopes from the front edge of the annular wall 75*b* to the outside toward the front Y1, and an annular stationary part 75*d* formed on the outside edge of the tapered portion 75*c*. The diaphragm valve 75 is supported by the frame 68 with the stationary part 75*d* fixed to the frame 68 and the center portion displaceable on the longitudinal axis Y.

When the frame 68 is covered by the front channel member 62, the diaphragm valve 75 forms part of the wall of the detour channel 66. When the frame 68 is covered by the front channel member 62, the annular rib 75*a* of the diaphragm valve 75 protrudes into the cavity 67. The diaphragm valve 75 is also opposite the bottom area where the top opening 65 is formed in the bottom 67*a* of the cavity 67.

The choke unit 46 includes the diaphragm valve 75, a disc moving mechanism 76 that displaces the diaphragm valve 75 on the longitudinal axis Y, and the drive motor 47 that drives the disc moving mechanism 76. The disc moving mechanism 76 moves the diaphragm valve 75 between a closed-channel position 75A (see FIGS. 7A-7C) where the diaphragm valve 75 is in contact with the bottom 67*a* (opposite wall part) of the cavity and closes the top opening 65, and an open-channel position 75B (see FIGS. 5A-5C) where the diaphragm valve 75 is removed to the front Y1 from the bottom 67*a* of the cavity.

The disc moving mechanism 76 is configured outside of the detour channel 66. As shown in FIG. 5B and FIG. 5C, the disc moving mechanism 76 includes a moving member 78 and a coil spring 79 (urging member). The moving member 78 includes a post 78*a* extending on the longitudinal axis Y, and an annular flange 78*b* that extends to the outside from the back end of the post 78*a*. The outside diameter of the post 78*a* is constant. The flange 78*b* is fixed to the inside side of the annular wall 75*b* of the diaphragm valve 75. The moving member 78 is inserted to the frame through-hole 70 of the frame 68, and is supported movably on the longitudinal axis Y by the frame 68. A steel pin 80 is attached to the front end part of the post 78*a*. The steel pin 80 extends on the transverse axis X perpendicularly to the axis of the post 78*a*. When the moving member 78 is attached to the diaphragm valve 75, it can move on the longitudinal axis Y between a closed position 78A (see FIGS. 7*a*-7C) where the diaphragm valve 75 is in the closed-channel position 75A, and an open position 78B (see FIGS. 5A-5C) where the diaphragm valve 75 is in the open-channel position 75B.

The coil spring 79 is disposed around the outside of the post 78*a*. The front end of the coil spring 79 contacts the bottom of the frame-side cavity 69. The back end of the coil spring 79 contacts the annular end of the moving member 78. The coil spring 79 urges the diaphragm valve 75 to the closed-channel position 75A by urging the moving member 78 to the closed position 78A.

The disc moving mechanism 76 includes a cam 81, link member 82, and power transfer mechanism 83 that transfers rotation of the drive motor 47 to the cam 81.

As shown in FIG. 5B, the cam 81 has a cam face 84 on the outside. The cam face 84 includes a first cam face 84*a* substantially parallel to the rotational axis of the cam 81, and a second cam face 84*b* that curves toward one side circumferentially to the inside circumference side from one circumferential end part of the first cam face 84*a*.

The link member 82 is supported rockably by the frame 68, and has a connecting part 87 connected to the steel pin 80 attached to the moving member 78, and a cam follower 82*a* that slides against the cam face 84. When the cam follower 82*a* slides against the first cam face 84*a*, the link member 82 positions the moving member 78 to the open position 78B. When the cam follower 82*a* slides against the second cam face 84*b* in the direction away from the first cam face 84*a*, the link member 82 rocks up to the back Y2. Next, as shown in FIG. 7B, when the cam follower 82*a* slides against the end part 84*c* of the second cam face 84*b* on the opposite side as the first cam face 84*a*, the link member 82 positions the moving member 78 to the closed position 78A.

As shown in FIG. 4 and FIGS. 6A and 6B, the power transfer mechanism 83 is a gear train mechanism. As shown in FIGS. 6A and 6B, the power transfer mechanism 83 includes an intermittent gear 85 fixed coaxially to the cam 81, and a transfer gear 86 that transfers rotation of the drive motor 47 to the intermittent gear 85.

The intermittent gear 85 has an intermittent gear body 88 with a toothed part 88*a* formed in one circumferential part thereof; a first latch member 89 having a first catch tooth 89*a* at one circumferential end of the toothed part 88*a* when seen from the axial end of the axle 88*b* of the intermittent gear body 88; a second latch member 90 having a second catch tooth 90*a* at the other circumferential end of the toothed part 88*a*; and a coil spring 91 (spring member) disposed between the first latch member 89 and the second latch member 90.

The first latch member 89 rotates on a first axle 89*b* parallel to the axle 88*b* of the intermittent gear body 88, and can move (see FIG. 8B between a first proximal position 89A where the first catch tooth 89*a* is proximal to the toothed part 88*a*, and a first retracted position 89B where the first catch tooth 89*a* is separated from the toothed part 88*a* in the opposite direction as the second latch member 90.

The second latch member 90 rotates on a second axle 90*b* parallel to the axle 88*b* of the intermittent gear body 88, and can move (see FIG. 6B between a second proximal position 90A where the second catch tooth 90*a* is proximal to the toothed part 88*a*, and a second retracted position 90B where the second catch tooth 90*a* is separated from the toothed part 88*a* in the opposite direction as the first latch member 89.

The coil spring 91 urges the first latch member 89 to the first proximal position 89A, and urges the second latch member 90 to the second proximal position 90A. More specifically, the coil spring 91 has one end thereof connected to the first latch member 89 and the other end connected to the second latch member 90, and thereby urges the first latch member 89 and the second latch member 90 together.

Choke Operation

In the choking operation whereby the ink path 35 is closed in the choke cleaning operation, the control unit 51 drives the drive motor 47 in a first direction for a predetermined first drive time only. As a result, when the cam 81 rotates in one direction from the position shown in FIGS. 5A-5C and FIGS. 6A and 6B, the cam follower 82*a* of the link member 82 slides from the first cam face 84*a* to the second cam face 84*b*, and reaches the end part 84*c* of the second cam face 84*b*. As a result, as shown in FIG. 7A-7C and FIGS. 8A and 8B, the moving member 78 moves from the open position 78B to the closed position 78A, and the diaphragm valve 75 therefore moves from the open-channel position 75B to the closed-channel position 75A.

When the diaphragm valve 75 moves to the closed-channel position 75A, the annular rib 75*a* of the diaphragm valve 75 contacts the outside edge part of the top opening 65 in the bottom 67*a* of the cavity 67 as shown in FIG. 7C. As a result, the flat channel 37 is cut off and the ink path 35 closes.

When the transfer gear 86 passes the toothed part 88*a* of the intermittent gear 85 and meshes with the first catch tooth 89*a* of the first latch member 89 while the drive motor 47 is driving the specific time, the first latch member 89 turns on the first axle 89*b* and moves from the first proximal position 89A to the first retracted position 89B as shown by the dotted line in FIG. 8B, and rotation of the intermittent gear body 88 therefore stops. The intermittent gear 85 therefore does not turn more than a specific angle of rotation. As a result, the cam 81 fixed coaxially to the intermittent gear 85 also does not turn more than a specific angle of rotation. The diaphragm valve 75 can therefore be moved accurately from the closed-channel position 75A to the open-channel position 75B even when driving the drive motor 47 is controlled by time.

When the choke cleaning operation ends, the control unit 51 opens the ink path 35.

More specifically, the control unit 51 drives the drive motor 47 in a second direction opposite the first direction for a predetermined drive time. As a result, as shown in FIG. 7B, when the cam 81 turns in the other direction opposite the one direction, the cam follower 82*a* of the link member 82 moves from the end part 84*c* of the second cam face 84*b* along the second cam face 84*b* to the first cam face 84*a*. As a result, as shown in FIGS. 5A-5C, the moving member 78 moves from the closed position 78A to the open position 78B, and the diaphragm valve 75 moves from the closed-channel position 75A to the open-channel position 75B.

When the drive motor 47 is driven in the second direction, the transfer gear 86 meshes with the first catch tooth 89*a* of the first latch member 89 at the first retracted position 89B as shown in FIG. 8B. Therefore, when the transfer gear 86 turns in the opposite direction as the arrow in FIG. 8B, the rotation of the drive motor 47 is transferred through the first latch member 89 to the intermittent gear body 88. As a result, the intermittent gear body 88 starts turning on its axle 88*b*, and the transfer gear 86 and the toothed part 88*a* of the intermittent gear body 88 then mesh. The drive force of the drive motor 47 is therefore transferred from the transfer gear 86 to the intermittent gear 85.

When the transfer gear 86 passes the toothed part 88*a* of the intermittent gear 85 and meshes with the second catch tooth 90*a* of the second latch member 90 while the drive motor 47 is driving the specific time, the second latch member 90 turns on its second axle 90*b* and moves from the second proximal position 90A to the second retracted position 90B as shown by the dotted line in FIG. 6B, and the intermittent gear body 88 therefore stops turning. The intermittent gear 85 therefore does not turn more than a specific angle of rotation. As a result, the cam 81 fixed coaxially to the intermittent gear 85 also does not turn more than a specific angle of rotation. The diaphragm valve 75 can therefore be accurately moved from the open-channel position 75B to the closed-channel position 75A even when driving the drive motor 47 is controlled by time.

Note that when the diaphragm valve 75 is in the closed-channel position 75A and the drive motor 47 turns again in the first direction to execute the choking operation, the transfer gear 86 meshes with the second catch tooth 90*a* of the second latch member 90 in the second retracted position 90B when the drive motor 47 is driven in the first direction as shown in FIG. 6B. Therefore, when the transfer gear 86 turns, the rotation of the drive motor 47 is transferred through the second latch member 90 to the intermittent gear body 88. As a result, the intermittent gear body 88 starts turning on its axle 88*b*, and the transfer gear 86 and toothed part 88*a* of the intermittent gear body 88 then engage. Drive power from the drive motor 47 is therefore transferred from the transfer gear 86 to the intermittent gear 85.

Effect of Operation

In this example, the disc of the choke unit 46 that closes the ink path 35 is a diaphragm valve 75 forming part of the wall of the ink path 35, and this diaphragm valve 75 is driven from outside the ink path 35 by a disc moving mechanism 76 that is driven by the drive motor 47. Displacement of the diaphragm valve 75 (the stroke of the disc) can therefore be greater than with a configuration that moves a disc inside the ink path 35 by means of magnetic force from outside the ink path 35. There is, therefore, no need for a disc inside the ink path 35 and a support member that supports the disc. Flow resistance when the ink path 35 is open can therefore be reduced.

This example also has an upstream opening (the top opening 65 of the downstream channel part 35*b* of the flat channel 37) to the ink path 35 located closer to the printhead 12 than the diaphragm valve 75 in the bottom 67*a* of the cavity 67 in the front channel member 62 opposite the diaphragm valve 75, and the diaphragm valve 75 closes this top opening 65 when in the closed-channel position 75A.

Closing the ink path 35 is therefore easy and the ink path 35 can be reliably closed.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. An inkjet printer comprising:

a printhead;

an ink path arranged to connect the printhead to an ink cartridge;

a diaphragm valve, the diaphragm valve forming a part of a wall of the ink path, the diaphragm valve including an annular rib disposed at center thereof;

a disc moving mechanism configured to move the diaphragm valve, between a closed-channel position where the annular rib of the diaphragm valve is in contact with an opposite wall part opposite the diaphragm and interposes on the ink path and an open-channel position where the diaphragm is retracted from the opposite wall part, the disc moving mechanism moving the diaphragm from outside of the ink path; and a drive motor that drives the disc moving mechanism.

2. The inkjet printer described in claim 1 wherein an upstream opening of a downstream channel part of the ink path located on the downstream side of the diaphragm valve is disposed to the opposite wall part and the diaphragm valve configured to close the upstream opening when in the closed-channel position.

3. The inkjet printer described in claim 1 wherein the disc moving mechanism includes:

a moving member that is attached to the diaphragm valve and moves between a closed position where the diaphragm valve is at the closed-channel position and an open position where the diaphragm valve is at the open-channel position;

an urging member configured to push the diaphragm valve to the closed-channel position by pushing the moving member to the closed position;

a cam;

a link member including a connecting part connected to the moving member, and a cam follower that slides against the cam; and a power transfer mechanism configured to transfer rotation of the drive motor to the cam;

the link member moving the moving member from the closed position to the open position when the drive motor drives in a first direction and rotates the cam and moving the moving member from the open position to the closed position when the drive motor turns in a second direction that is the reverse of the first direction and rotates the cam.

4. The inkjet printer described in claim 3 wherein:

the power transfer mechanism has an intermittent gear connected coaxially to the cam, and a transfer gear that transfers rotation of the drive motor to the intermittent gear;

the intermittent gear has an intermittent gear body with a toothed part formed to part of the circumference;

a first latch member having a first catch tooth at one circumferential end of the toothed part when seen from the axial end of the axle of the intermittent gear body;

a second latch member having a second catch tooth at the other circumferential end of the toothed part; and a spring member;

the first latch member rotating on a first axle parallel to the axle of the intermittent gear body and moving between a first proximal position where the first catch tooth is proximal to the toothed part, and a first retracted position where the first catch tooth is removed to one side from the toothed part;

the second latch member rotating on a second axle parallel to the axle of the intermittent gear body and moving between a second proximal position where the second catch tooth is proximal to the toothed part, and a second retracted position where the second catch tooth is removed to the other side from the toothed part; and the spring member urging the first latch member to the first proximal position and urging the second latch member to the second proximal position.

5. The inkjet printer described in claim 3 further comprising a control unit configured to control driving the drive motor and move the diaphragm valve by driving the drive motor a predetermined drive time in the first direction or the second direction.

* * * * *